US009488079B2

(12) United States Patent
Bartlett

(10) Patent No.: US 9,488,079 B2
(45) Date of Patent: Nov. 8, 2016

(54) MUFFLER FOR AUTOMOBILE

(71) Applicant: William Lee Bartlett, San Bernardino, CA (US)

(72) Inventor: William Lee Bartlett, San Bernardino, CA (US)

(73) Assignee: Black Widow Performance, Inc., Santa Ana, CA (US)

( * ) Notice: Subject to any disclaimer, the term of this patent is extended or adjusted under 35 U.S.C. 154(b) by 20 days.

(21) Appl. No.: 13/761,038

(22) Filed: Feb. 6, 2013

(65) Prior Publication Data

US 2016/0010524 A1 Jan. 14, 2016

Related U.S. Application Data

(60) Provisional application No. 61/596,088, filed on Feb. 7, 2012.

(51) Int. Cl.
*F01N 1/02* (2006.01)
*F01N 13/18* (2010.01)

(52) U.S. Cl.
CPC ..... *F01N 1/026* (2013.01); *F01N 13/1872* (2013.01); *F01N 2470/02* (2013.01); *F01N 2470/30* (2013.01)

(58) Field of Classification Search
CPC ..... F01N 1/1083; F01N 2470/08; F01N 2470/10; F01N 2470/30
USPC ..... 181/250, 264, 267, 268, 270, 272, 273, 181/276, 281
See application file for complete search history.

(56) References Cited

U.S. PATENT DOCUMENTS 2,122,086 A * 6/1938 Chase ..... F01N 1/089 181/269
2,512,155 A * 6/1950 Hill ..... F01N 1/00 181/249
3,987,868 A * 10/1976 Betts ..... F01N 1/089 181/269
5,739,484 A * 4/1998 Jones ..... F01N 1/04 181/264
5,773,770 A * 6/1998 Jones ..... F01N 1/02 181/239
5,892,186 A * 4/1999 Flugger ..... F01N 1/04 181/252
6,364,054 B1 * 4/2002 Bubulka ..... F01N 1/003 181/264
7,549,512 B2 * 6/2009 Newberry ..... F01N 1/08 181/264
2011/0088968 A1 * 4/2011 Kempf ..... F01N 1/023 181/250

FOREIGN PATENT DOCUMENTS

JP 57102507 A * 6/1982

* cited by examiner

*Primary Examiner* — Jeremy Luks
(74) *Attorney, Agent, or Firm* — Stetina Brunda Garred & Brucker

(57) ABSTRACT

A muffler for an exhaust system of a gas combustion engine, which comprises a muffler body (14) connected to an exhaust pipe inlet (10*a*), an exhaust pipe outlet (11*a*) to the tailpipe connected to the muffler body (14), and adjacent baffles (23, 24) within the muffler body (14), characterized in that the exhaust pipe inlet (10*a*), the exhaust pipe outlet (11*a*) and the adjacent baffles (23, 24) are in line without significant restriction to gas exhaust flow and having baffle openings (21, 22) and baffle louver openings (18*b*, 19*b*) to the central muffler chamber (17), whereby the central muffler chamber route (17) is generally a straight line from the exhaust inlet pipe (10*a*) to the exhaust pipe outlet (11*a*).

20 Claims, 5 Drawing Sheets

MUFFLER FOR AUTOMOBILE

CROSS-REFERENCE TO RELATED APPLICATIONS

This application claims the benefit of the provisional patent application Ser. No. 61/596,088, filed 2012 Feb. 7, entitled "Muffler for Automobile".

BACKGROUND

The present application relates to the field of exhaust mufflers and, more particularly, to automotive mufflers. Automotive mufflers are created using different methods to channel gas exhaust through exhaust pipes in order to displace and muffle engine sound. Because of their complexity, many of these methods are over-thought and over-designed resulting in restricted performance and efficiency to the engine. Most engines perform at maximum capacity when exhaust airflow is not restricted. Mufflers that contain multiple and complex baffles to channel exhaust airflow create backflow pressure to the engine causing loss of performance and efficiency. Complex baffle designs can be expensive and complicated to manufacture. Other designs use packing, which typically consists of a fiberglass material placed within the muffler to displace sound. Due to extreme temperatures produced from the engine to the muffler, packing eventually hardens and breaks down, thus creating undesirable sound and ultimately the need for replacement.

SUMMARY

In one aspect, the disclosure provides baffles permanently contained in a fixed location within the muffler body allowing for direct airflow through the muffler chamber resulting in increased performance and efficiency from the engine. Due to the simplicity of the design, the manufacturing process is simple to achieve and requires minimal labor effort to assemble.

DETAILED DESCRIPTION

Figure 1A:
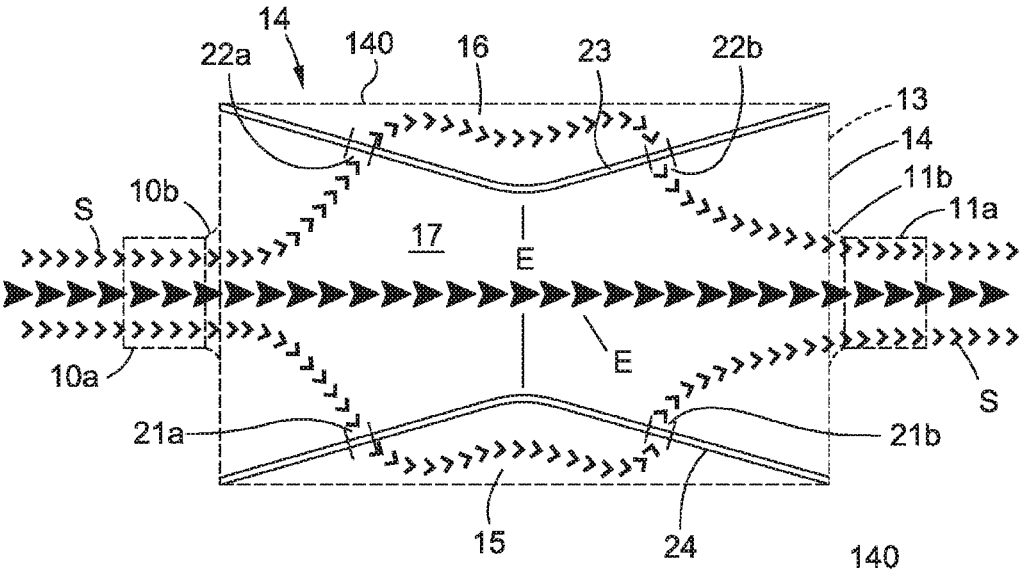
FIG. 1A is a top partially cut away view showing an automotive muffler according to one embodiment.

FIGS. 1A, 1C, 1D and 2 illustrate one embodiment of an automotive muffler for the exhaust system of a gas combustion engine. FIG. 1A is a top view of the automotive muffler, which can be made of a metal, such as steel or stainless steel. In the illustrated embodiment, the automotive muffler has a muffler casing or body 14 which includes an exhaust inlet end cap 12 and an opposing exhaust outlet end cap 13. An outer wall 140 extends between the end caps 12, 13. The end caps 12, 13 can be joined to opposite ends of the outer wall 140 such as by welding. In the illustrated embodiment, the muffler body 14 has an elongated, rectangular box-like structure and can have rounded longitudinal edges. A center muffler chamber 17 is formed within the muffler body 14.

An exhaust pipe inlet 10*a* can be joined to the inlet end cap 12 by inserting the exhaust pipe inlet 10*a* through a hole in the inlet end cap 12 and then welded to the inlet end cap 12 via an exhaust pipe inlet flange 10*b*. Similarly, an exhaust pipe outlet 11*a* is joined to the outlet end cap 13 by first inserting the exhaust pipe outlet 11*a* through a hole in the outlet end cap 13 and then welding an exhaust pipe outlet flange 11*b* to the outlet end cap 13. The exhaust pipe inlet 10*a*, the first end cap 12, the exhaust pipe outlet 10*b*, and the second end cap 13 can be made of metal. Gas exhaust can follow an exhaust flow path E entering the automotive muffler through the exhaust pipe inlet 10*a* and exiting through the exhaust pipe outlet 11*a*. The exhaust pipe inlet 10*a* and the exhaust pipe outlet 11*a* can be substantially aligned along the longitudinal axis of the muffler body 14. The exhaust flow path E can extend in a straight line from the exhaust pipe inlet 10*a* to the exhaust pipe outlet 11*a*, uninterrupted by any internal structure within the muffler body 14.

Figure 1B:
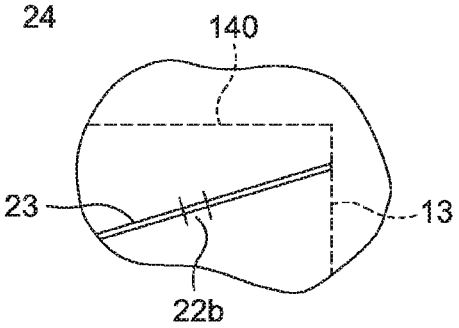
FIG. 1B shows a portion of another embodiment of an automotive muffler.

With continued reference to FIGS. 1A, C & D and 2, a baffle 23 having an upstream portion and a downstream portion is enclosed within the muffler body 14. The illustrated baffle 23 is elongated, has top and bottom surfaces, and opposite ends extending the full length of the muffler body 14. An upstream end of the baffle 23 is attached at a first corner of the muffler body 14 where the inlet end cap 12 meets the outer wall 140. A downstream end of the baffle is attached at a second corner of the muffler body 14 where the outlet end cap 13 meets the outer wall 140. FIG. 1B shows another embodiment in which the ends of the baffle 23 are not attached to the muffler body 14 at the first and second corners, but instead are attached to the ends caps at locations spaced from the associated corner in order to fit different muffler casing designs.

The baffle 23 can be made of any material, such as metal, including 14 gauge steel or stainless steel. The baffle 23 preferably is attached to the muffler body 14 along the entirety of both the top and bottom surfaces, preferably by top and bottom welds that each extend the complete length of the baffle 23. Preferably the ends of the baffle 23 are attached along their complete height, preferably by welds that extends the entire height of the ends.

The length of the baffle can be between 14 inches to 16 inches or any length, depending on the application and design. The height of the baffle 23 can be around 4 inches to 5 inches or any height, depending on the application and design.

As best shown in FIG. 1A, the upstream portion and the downstream portion of the baffle 23 can be separated by a bend in the baffle 23. As shown, the upstream portion extends from the upstream end cap in a direction transverse to the longitudinal axis so as to narrow the exhaust flow path E. The downstream portion extends from the bend to the downstream end cap also in a direction transverse to the longitudinal axis but oriented so as to broaden the exhaust flow path.

The baffle 23 cooperates with the outer wall 140 to define a sound cancelling chamber, or baffle chamber 16 within the muffler body 14, which baffle chamber 16 is separated from the muffler chamber 17 by the baffle 23. In the illustrated embodiment, the baffle chamber 16 is generally triangular in shape.

Figure 1C:
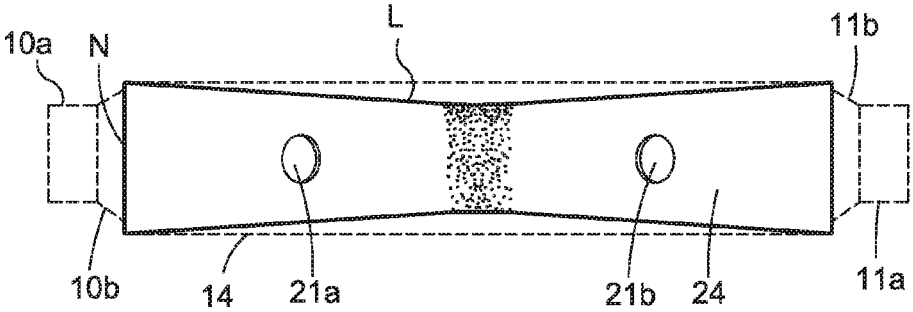
FIG. 1C is a side view of the arrangement of FIG. 1A.
Figure 1D:
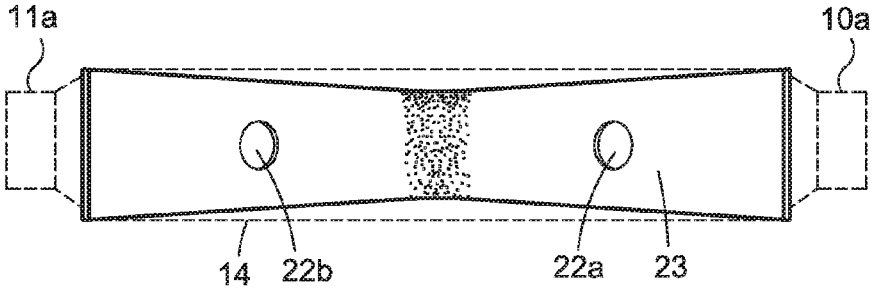
FIG. 1D is another side view of the arrangement of FIG. 1A.

A baffle upstream sound hole or upstream aperture 22*a* is formed through the upstream portion. A downstream sound hole or aperture 22*b* is formed through the downstream portion of the baffle 23. In the illustrated embodiment of FIG. 1, and as shown in FIGS. 1C and 1D, the upstream and downstream apertures 22*a, b* are each a circular hole about 1¼ inches in diameter located approximately midway along the upstream portion and midway along the downstream portion. The location, size, shape, and number of the apertures 22*a*, 22*b* can change based on application and design.

Figure 2:
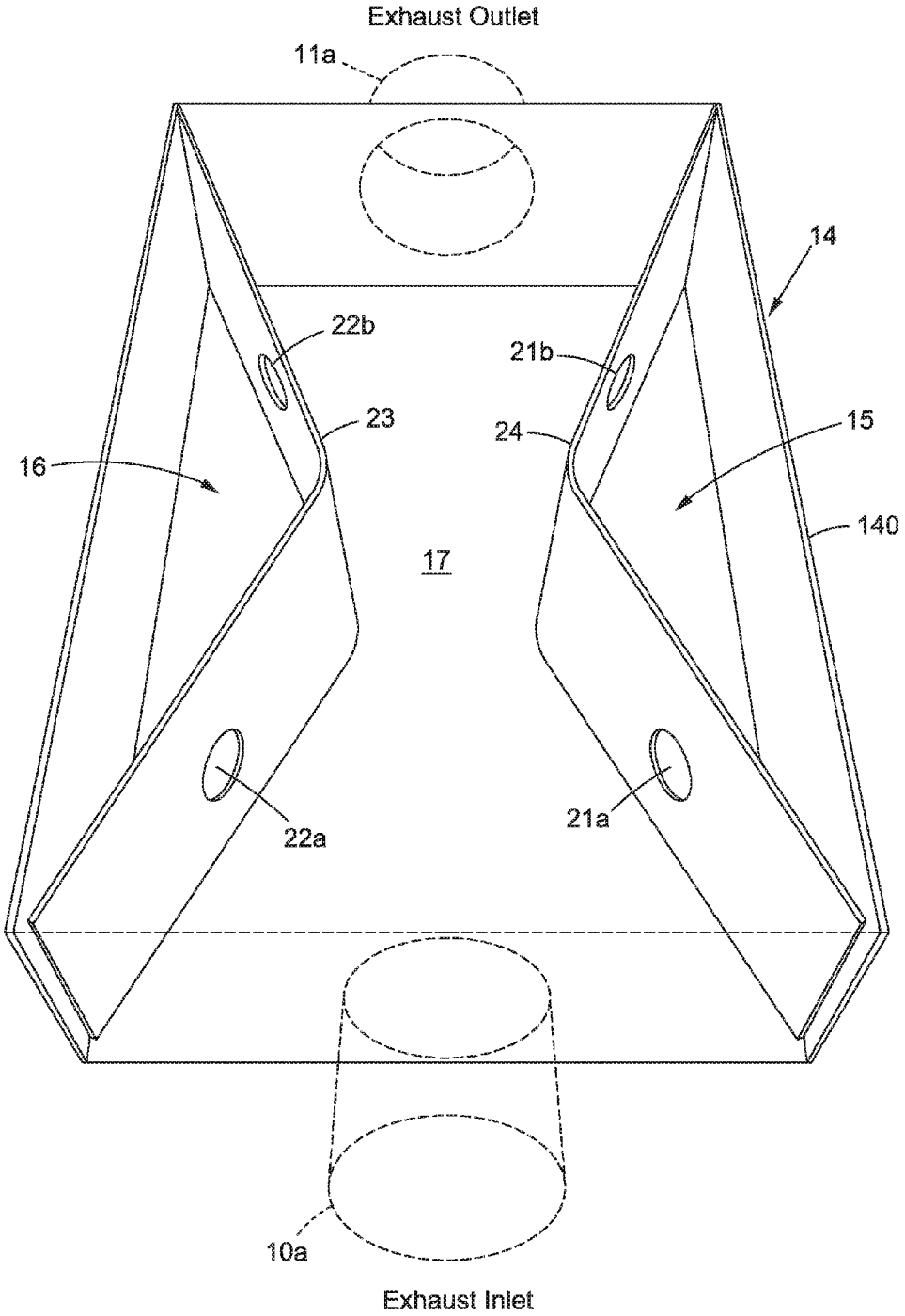
FIG. 2 is an isometric view of internal components of the automotive muffler of FIG. 1A.

With continued reference to FIGS. 1A and 2, the apertures 22*a*, 22*b* are designed to trap and muffle sound. Since the baffle 23 is connected along its top and bottom and at its ends, the baffle sound holes preferably are the only air pathways into and out of the sound cancelling chamber 16. As shown, preferably a portion of the sound associated with exhaust follows a sound travel path S into the muffler chamber 17 through the inlet pipe 10*a*, and then into the sound cancelling chamber 16 through the upstream baffle aperture 22*a*. Sound is trapped and muffled in the chamber 16, and exits back into the muffler chamber 17 via the downstream baffle aperture 22*b* and exits the muffler via the outlet pipe 11*a*.

With continued reference to FIGS. 1A, B & C and 2, a second baffle 24 that mirrors the first baffle 23 can be placed opposite the longitudinal axis of the muffler body 14. The second baffle 24 would also have an upstream and a downstream portion, one or more upstream apertures 21*a*, one or more downstream apertures 21*b*, further divide the muffler chamber 17 into a smaller muffler chamber 17 and another baffle chamber 15, and define a sound pathway S through the baffle chamber 15.

In the illustrated embodiment, the muffler chamber 17 is generally hourglass-shaped, having wide portions at or adjacent the inlet and the outlet portions of the muffler body 14. A narrowed portion of the muffler chamber 17 is defined between the bends of the baffles 23, 24. Preferably the narrowed portion is substantially midway along the length of the muffler body 17 such that the upstream portions and the downstream portions of the baffles 23, 24 have approximately the same length. In one embodiment, the narrowed portion is about 5 inches wide, but this width can vary depending on application, baffle angle, and muffler body width. In the illustrated embodiment, the narrowed portion is the narrowest space along the length of the exhaust pathway E.

Figure 3:
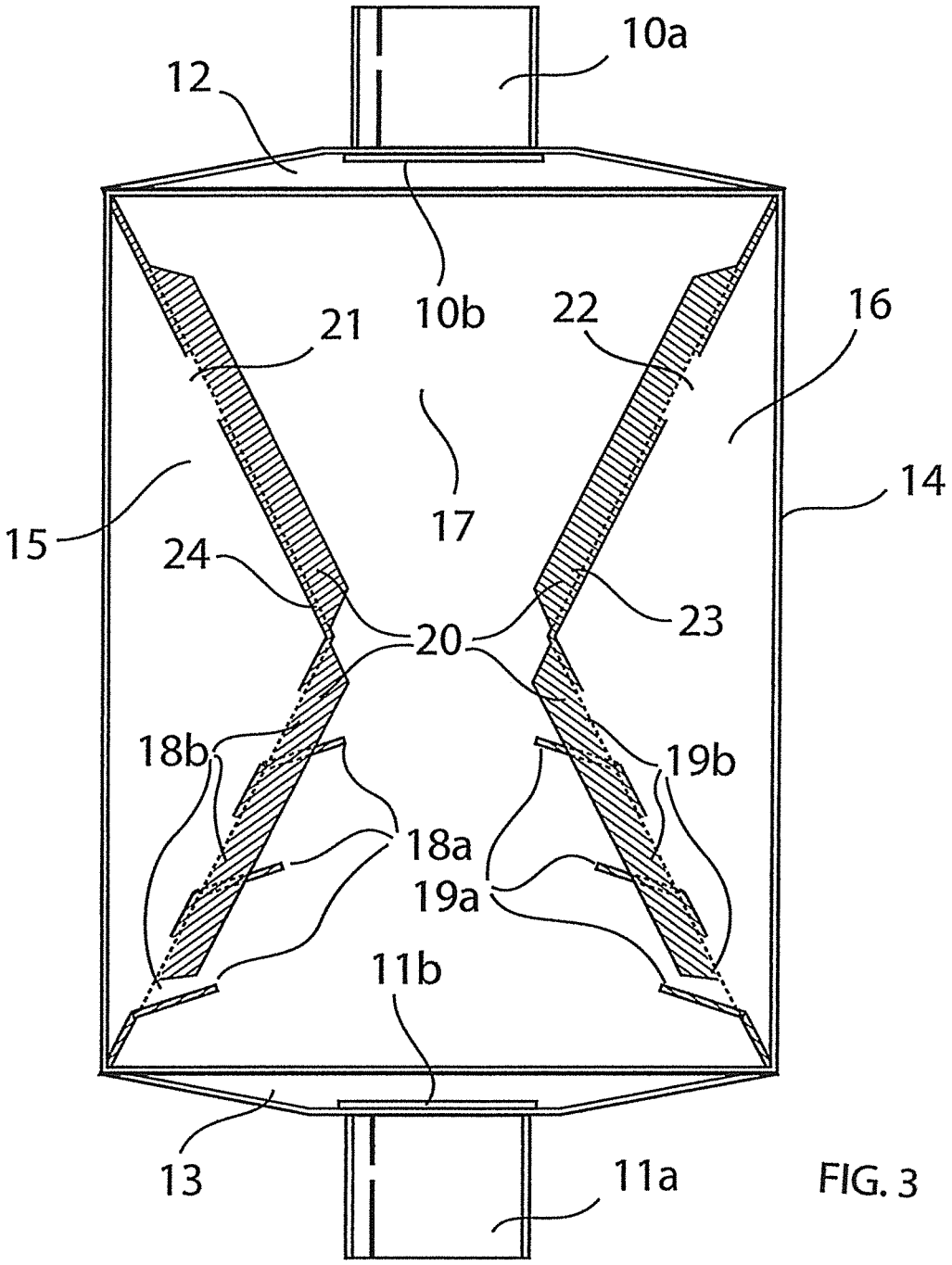
FIG. 3 is a top, partially-cut away view of another embodiment of an automotive muffler.
Figure 4:
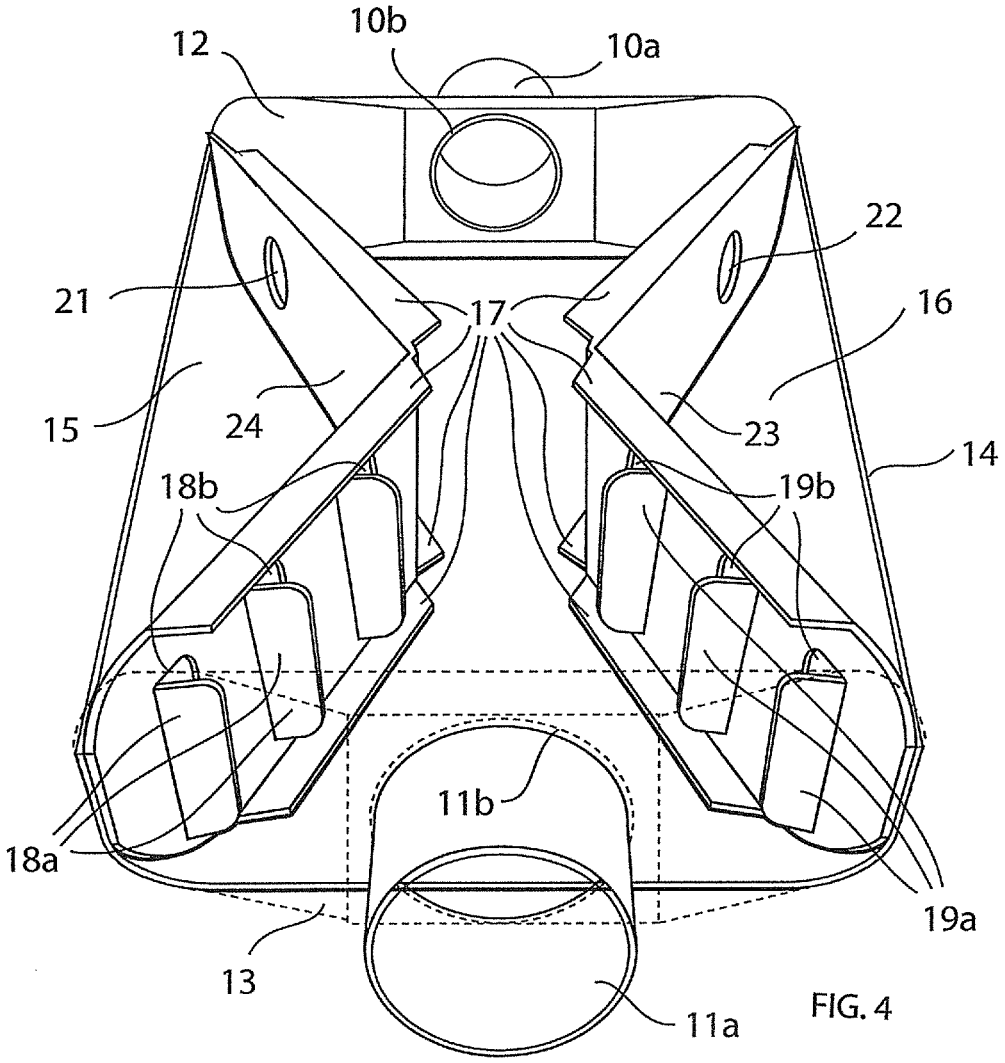
FIG. 4 is an assembled isometric view of the automotive muffler of FIG. 3.
Figure 5:
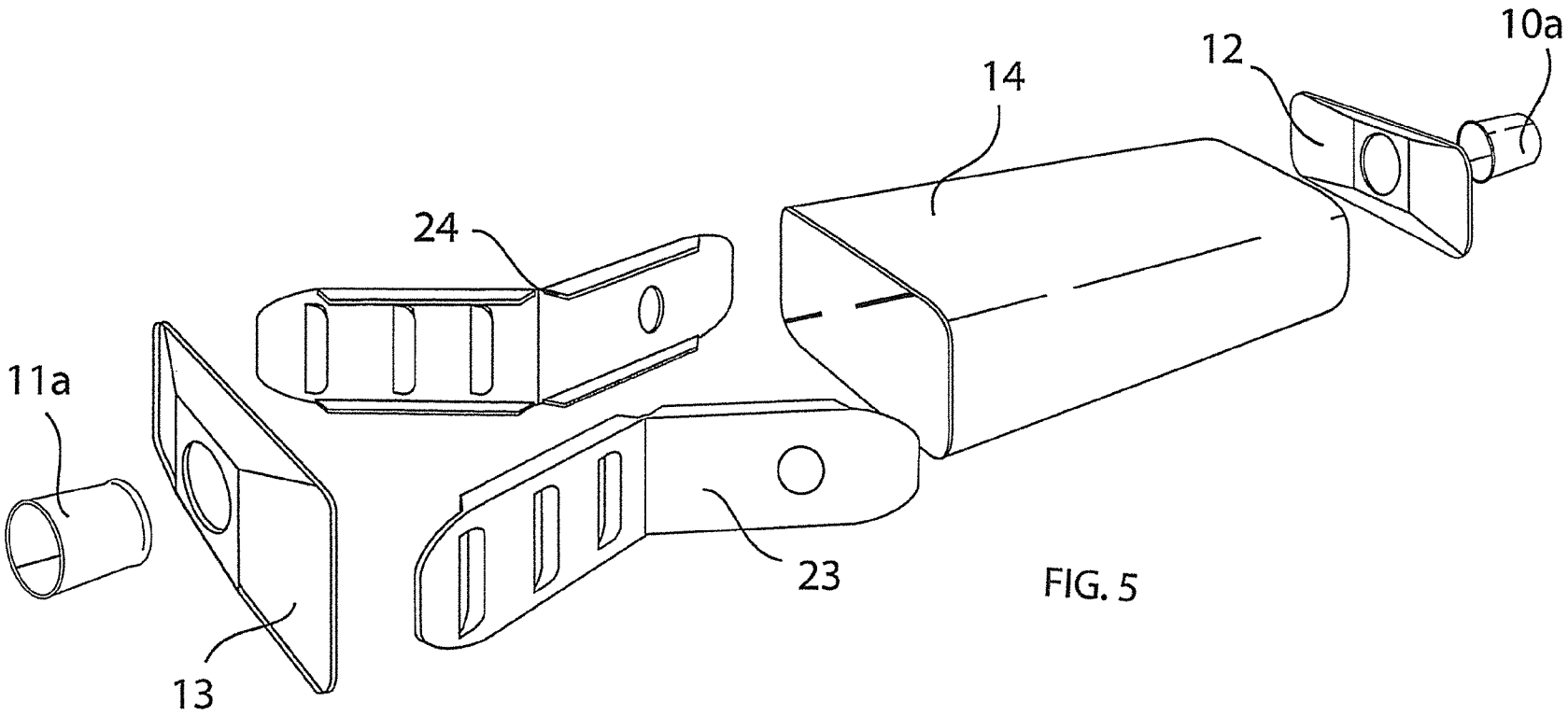
FIG. 5 is an exploded isometric view of the automotive muffler of FIG. 3.

FIGS. 3-5 illustrate another embodiment of an automotive muffler having a casing or muffler body 14 enclosing a muffler chamber 17. An exhaust inlet pipe 10*a* extends through an end cap 12 to deliver exhaust to the muffler chamber 17. Exhaust exits the chamber 17 through an exhaust outlet pipe 11*a* that extends through an end cap 13. A baffle 23 within the body 14 defines a baffle chamber 16 that is separated from the muffler chamber 17. A baffle 24 is a mirror image of baffle 23 and defines a baffle chamber 15 that is separated from the muffler chamber 17. As such, the muffler chamber 17 has an hourglass shape. Weld supports 20 along the longitudinal top and bottom of each baffle can be welded to the interior of the muffler body 14.

The illustrated baffles 23, 24 each have one upstream sound hole 22, 21, formed through an upstream portion of the respective baffle. Each baffle also has three downstream sound holes 19*b*, 18*b* formed through a downstream portion of each baffle, which downstream portion is defined as the part downstream along the exhaust flow path from the narrowest part of the hourglass shape. In the illustrated embodiment, the upstream sound holes 21, 22 are each circular, and are each located off center of the upstream portion of the baffle 23, 24. More specifically, the upstream holes are located somewhat forward of the center of each upstream portion.

With continued reference to FIGS. 3-5, in the illustrated embodiment, the downstream apertures 18*b*, 19*b* are generally rectangular, and each have an adjacent latitudinal louver 18*a*, 19*a* extending from a downstream edge of the associated downstream aperture 18*b*, 19*b*. In the illustrated embodiment, each louver extends in a direction away from the baffle chambers 15, 16 into the muffler chamber 17. The illustrated louvers 18*a*, 19*a* are generally straight and extend in a direction transverse to the longitudinal axis. In the illustrated embodiment, the louvers 18*a*, 19*a* extends in a direction generally towards the exhaust pipe inlet 10*a*. The louvers 18*a*, 19*a* can be formed by partially punching out the downstream apertures 18*b*, 19*b* and bending the louvers 18*a*, 19*a* at the downstream edge of the downstream apertures 18*b*, 19*b*.

In accordance with one embodiment, a method for making an automotive muffler as in FIGS. 3 and 4 is provided. In accordance with the embodiment, a metal such as steel or stainless steel is cut to create the muffler body 14. The steel is bent longitudinally to form a uniform muffler body 14 and muffler chamber 17. The formed muffler body 14 is then welded on the exterior of one side to create a solid muffler body 14. The formed muffler body 14 can be sealed by creating a weld along one side of the longitudinal length of the formed muffler body 14. Two baffles 23, 24 are cut out of steel or stainless steel, then bent at equal locations creating the initial stages of the baffle chambers 15, 16. Baffle weld supports 20 are then bent outward toward the center of the muffler chamber 17 and welded to the muffler body 14. The baffles 23, 24 can be secured to the muffler body 14 by multiple welds along the weld support locations. The baffles can also be secured to the muffler body by multiple weld locations along the inside latitudinal edge. The exhaust inlet pipe 10*a* and exhaust outlet pipe 11*a* can be joined to respective end caps 12, 13 by first inserting the exhaust inlet and outlet pipes 10*a*, 11*a*, through hole in the associated end caps 12, 13 and then welding the pipes to the end caps via associated exhaust pipe flanges 10*b*, 11*b*. The end caps 12, 13 can then be welded to the respective ends of the muffler body 14.

I claim:

1. An automotive muffler, comprising:

an elongated body having an axis and comprising first and second opposing end caps and an elongated outer wall extending between the end caps, the body defining a muffler chamber therewithin;

an exhaust inlet formed through the first end cap and an exhaust outlet formed through the second end cap, an exhaust flow path extending between the exhaust inlet and the exhaust outlet;

an elongated baffle having opposing ends and top and bottom surfaces that are attached to the outer wall of the elongated body and abut the elongated body along the length of the elongated baffle so that a baffle chamber is defined between the baffle and the outer wall, the baffle chamber separated from the muffler chamber by the baffle, the muffler chamber extending along the axis and being defined between the elongated baffle and the elongated body;

an upstream portion of the elongated baffle extending in a direction transverse to the axis so as to narrow the exhaust flow path;

a downstream portion of the elongated baffle extending in a direction transverse to the axis so as to broaden the exhaust flow path, the upstream and downstream portions being contiguous and meeting at a baffle bend;

an upstream aperture formed through the upstream portion of the elongated baffle; and a downstream aperture formed through the downstream portion of the elongate baffle.

2. An automotive muffler as in claim 1, wherein the exhaust flow path follows a straight line from the exhaust inlet to the exhaust outlet.

3. An automotive muffler as in claim 1, wherein there are more downstream apertures than upstream apertures.

4. An automotive muffler as in claim 3, wherein the upstream aperture is circular, and the downstream aperture is non-circular.

5. An automotive muffler as in claim 4 additionally comprising a louver adjacent the downstream aperture, the louver extending from a downstream edge of the downstream aperture, the louver extending away from the baffle chamber and into the muffler chamber.

6. An automotive muffler as in claim 1, wherein the upstream portion is the same length as the downstream portion.

7. An automotive muffler as in claim 1, wherein the baffle additionally comprises elongated weld supports along the length of the top and bottom surfaces, and wherein the weld supports are welded to the outer wall of the elongated body to form the baffle chamber.

8. An automotive muffler as in claim 1, wherein the elongated body has a generally rectangular cross-section viewed perpendicular to the axis, and the muffler chamber and the baffle chamber each extend from a bottom to a top of the elongated body.

9. An automotive muffler as in claim 1 additionally comprising a second elongated baffle having top and bottom surfaces that abut the outer wall of the elongated body along the length of the second elongated baffle so that a second baffle chamber is defined between the second elongated baffle and the outer wall, the second baffle chamber separated from the muffler chamber by the second elongated baffle.

10. An automotive muffler as in claim 9, wherein the muffler chamber is between the baffle chamber and the second baffle chamber.

11. An automotive muffler as in claim 10, wherein the second elongated baffle mirrors the elongated baffle about the axis of the elongated body, and wherein the muffler chamber, the baffle chamber, and the second baffle chamber each extend from a bottom to a top of the elongated body.

12. An automotive muffler as in claim 11, wherein the baffle chamber and second baffle chamber are generally triangular.

13. An automotive muffler, comprising:

an elongated body having an axis and comprising first and second opposing end caps and an elongated outer wall extending between the end caps, the body defining a muffler chamber therewithin;

an exhaust inlet formed through the first end cap and an exhaust outlet formed through the second end cap, an exhaust flow path extending between the exhaust inlet and the exhaust outlet;

an elongated baffle having opposing ends and top and bottom surfaces that are attached to the outer wall of the elongated body so that a baffle chamber is defined between the baffle and the outer wall, the baffle chamber separated from the muffler chamber by the baffle;

an upstream portion of the elongated baffle extending in a direction transverse to the axis so as to narrow the exhaust flow path;

a downstream portion of the elongated baffle extending in a direction transverse to the axis so as to broaden the exhaust flow path, the downstream portion meeting the upstream portion at a baffle bend;

an upstream aperture formed through the upstream portion of the elongated baffle; and a downstream aperture formed through the downstream portion of the elongate baffle;

wherein the elongated baffle defines a triangular baffle chamber with the outer wall.

14. An automotive muffler as in claim 13 additionally comprising a second elongated baffle arranged within the muffler body so as to mirror the elongated baffle.

15. An automotive muffler as in claim 14, wherein the elongated baffle and second elongated baffle are arranged in an hourglass configuration when viewed from the top or the bottom of the elongated body, but not when viewed from the side of the elongated body, and wherein the second elongated baffle defines a triangular second baffle chamber with the outer wall.

16. An automotive muffler, comprising:

an elongated body having an axis and comprising first and second opposing end caps and an elongated outer wall extending between the end caps, the body defining a muffler chamber therewithin;

an exhaust inlet formed through the first end cap and an exhaust outlet formed through the second end cap, an exhaust flow path extending between the exhaust inlet and the exhaust outlet;

an elongated baffle having opposing ends and top and bottom surfaces that are attached to the outer wall of the elongated body so that a baffle chamber is defined between the baffle and the outer wall, the baffle chamber separated from the muffler chamber by the baffle;

an upstream portion of the elongated baffle extending in a direction transverse to the axis so as to narrow the exhaust flow path;

a downstream portion of the elongated baffle extending in a direction transverse to the axis so as to broaden the exhaust flow path;

an upstream aperture formed through the upstream portion of the elongated baffle;

a downstream aperture formed through the downstream portion of the elongate baffle; and a louver adjacent the downstream aperture, the louver extending from a downstream edge of the downstream aperture, the louver extending away from the baffle chamber and into the muffler chamber.

17. An automotive muffler as in claim 16, wherein the louver is straight and extends in a direction transverse to the axis.

18. An automotive muffler as in claim 17, wherein the louver extends in a direction generally toward the exhaust inlet.

19. An automotive muffler as in claim 16 additionally comprising a second elongated baffle arranged within the muffler body so as to mirror the elongated baffle.

20. An automotive muffler as in claim 16, wherein the louver is straight and extends in a direction transverse to the axis.

* * * * *